US006312563B1

(12) United States Patent
Goodnow et al.

(10) Patent No.: US 6,312,563 B1
(45) **Date of Patent: *Nov. 6, 2001**

(54) REMOVABLE DOCTOR BLADE HOLDER

(75) Inventors: Ronald F. Goodnow, Leicester; Robert A. Reid, Charlton City, both of MA (US)

(73) Assignee: Thermo Web Systems, Inc., Auburn, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/400,137

(22) Filed: Sep. 21, 1999

Related U.S. Application Data

(60) Provisional application No. 60/068,463, filed on Dec. 22, 1997.

(51) Int. Cl.[7] ..... B31F 1/12; B05C 1/06; A46B 15/00

(52) U.S. Cl. ..... 162/281; 118/261; 15/256.51

(58) Field of Search ..... 162/281; 118/413, 118/126, 261; 101/157, 169, 365; 15/256.51

(56) References Cited

U.S. PATENT DOCUMENTS

| | | | | |
|---|---|---|---|---|
| 1,696,119 | | 12/1928 | Heisel . | |
| 3,593,663 | | 7/1971 | Vischulis . | |
| 3,645,844 | | 2/1972 | Grenier . | |
| 3,780,670 | | 12/1973 | Abler et al. . | |
| 3,854,162 | | 12/1974 | Russell . | |
| 4,241,691 | | 12/1980 | Hopfe et al. . | |
| 4,459,176 | | 7/1984 | Goodnow . | |
| 4,665,859 | | 5/1987 | Dunlap et al. . | |
| 4,789,432 | * | 12/1988 | Goodnow et al. | 162/281 |
| 4,821,672 | | 4/1989 | Bruno . | |
| 4,906,335 | * | 3/1990 | Goodnow et al. | 162/281 |
| 5,070,783 | | 12/1991 | Ireton . | |
| 5,389,151 | | 2/1995 | Fort . | |
| 5,406,887 | | 4/1995 | Hertel et al. . | |
| 5,980,692 | * | 11/1999 | Goodnow et al. | 162/281 |

FOREIGN PATENT DOCUMENTS

| | | |
|---|---|---|
| 0294992 A2 | 12/1988 | (EP) . |
| 0485597 A1 | 5/1992 | (EP) . |

* cited by examiner

*Primary Examiner*—Stanley S. Silverman
*Assistant Examiner*—Dianne A. Walls
(74) *Attorney, Agent, or Firm*—Samuels, Gauthier & Stevens

(57) ABSTRACT

An apparatus for doctoring a roll in a paper machine, comprising a doctor blade and an integral blade holder including a support tray carrying fluid actuated tubes for applying the doctor blade to the roll. The blade holder is removably mounted on and releasably secured to the doctor back.

7 Claims, 4 Drawing Sheets

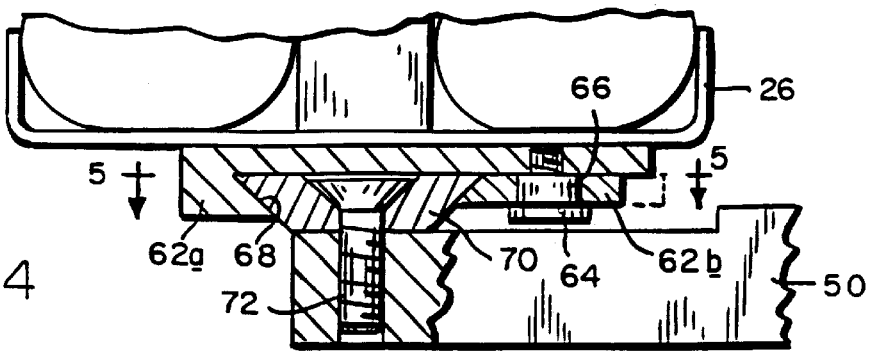
FIG. 4
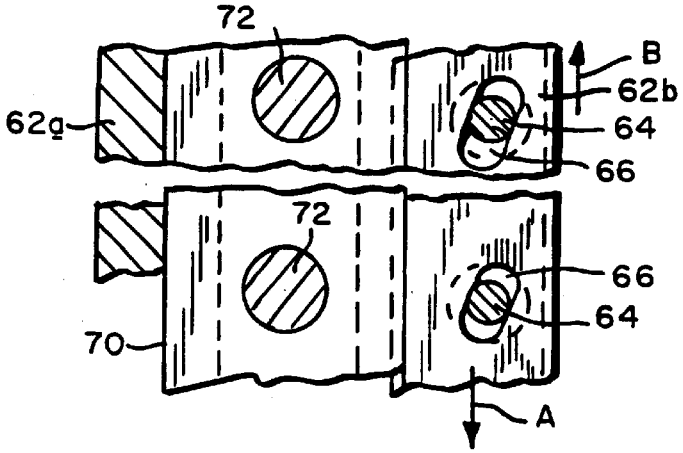
FIG. 5
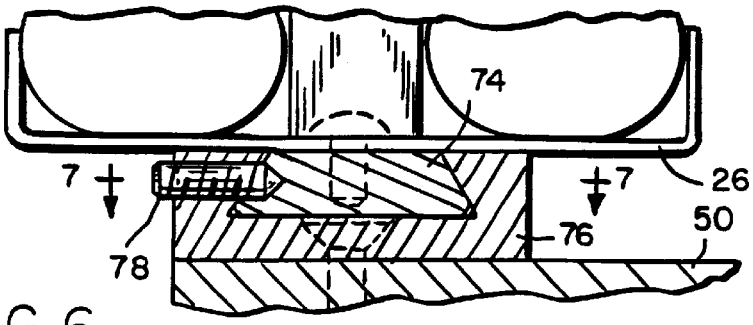
FIG. 6
FIG. 7
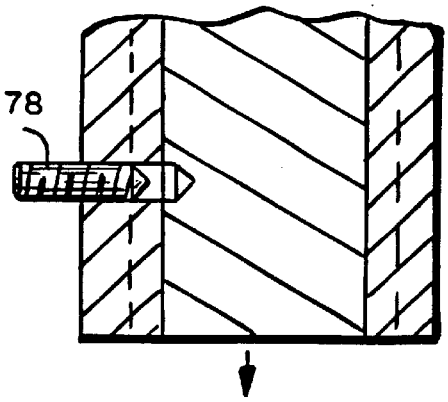

REMOVABLE DOCTOR BLADE HOLDER

CROSS REFERENCE TO RELATED APPLICATIONS

This application claims priority from provisional application Ser. No. 60/068,463 filed Dec. 22, 1997 and entitled REMOVABLE DOCTOR BLADE HOLDER.

BACKGROUND OF THE INVENTION

1. Field of the Invention

This invention relates generally to doctors used, in papermaking machines, and is concerned in particular with the provision of a blade holder which is readily separable from the doctor back and removable from the papermaking machine for cleaning, inspection and repair.

2. Description of the Prior Art

The main components of a doctor system include the doctor blade, the blade holder, the doctor back and the loading mechanism. The doctor blade keeps the roll clean and/or sheds the sheet. It must be perfectly flat, straight and parallel, and its composition must be compatible with the roll to be doctored.

The blade holder exerts a uniform, designated load pressure on the blade. It holds the blade firmly against the roll, accommodates roll irregularities and, within limits, compensates for thermal expansion.

The doctor back is in essence the backbone of the doctor. It serves as the support structure for the blade holder. The loading mechanism pivots the doctor back to load the doctor blade against the roll.

Doctor blade holder designs used in recent years are more complex and have more components than the simpler blade holders used in the past. As a result, the more recent holder designs require more routine cleaning and maintenance. The doctor blade holders are normally mounted to the doctor back rigidly with a series of fasteners. Maintenance and cleaning of the blade holder can take place while the doctor remains in the machine but only in installations where the holder is accessible. However, in many cases, papermachine framework or other equipment prevents access to the blade holder while it is in the papermachine. In these cases, the complete doctor structure including the doctor back and attached holder must be removed from the papermachine to perform any cleaning or maintenance work. This task involves removing heavy equipment which requires extensive manpower and machine downtime. After making the necessary repairs, the entire doctor assembly must be re-installed in the papermachine, consuming more valuable manpower and time. In addition to the re-installation, the doctor must be re-aligned to the roll surface for optimum doctor performance.

SUMMARY OF THE INVENTION

The present invention avoids or at least significantly minimizes the above mentioned problems by providing a doctor blade holder which is readily separable from the supporting doctor back. Thus, while the doctor back remains undisturbed in the papermachine, operating personnel can remove the blade holder for cleaning and maintenance. Thereafter, the blade holder is returned to its operative position on the doctor back and locked in place. Certain embodiments of the invention further include the provision of a releasable clamping mechanism for clamping the blade holder in place on the doctor back during papermachine operation.

BRIEF DESCRIPTION OF THE DRAWINGS

These and other objectives, features and advantages of the present invention will be described in greater detail with reference to the accompanying drawings; wherein:

FIG. 4 is a view similar to FIG. 2 showing an alternative embodiment of a blade holder in accordance with the present invention;

FIG. 5 is a horizontal sectional view taken along line 5—5 of FIG. 4;

FIG. 6 illustrates another embodiment of a blade holder in accordance with the present invention;

FIG. 7 is a horizontal sectional view taken along line 7—7 of FIG. 6;

DETAILED DESCRIPTION OF PREFERRED EMBODIMENTS

Figure 1:
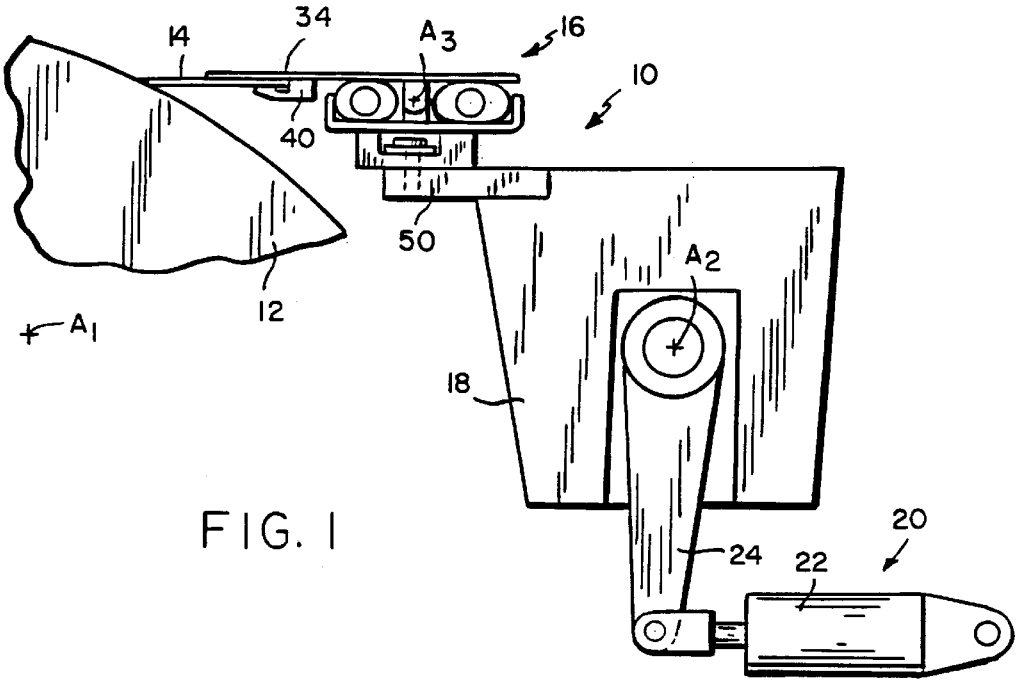
FIG. 1 is a side view of a doctor assembly in accordance with the present invention.
Figure 2:
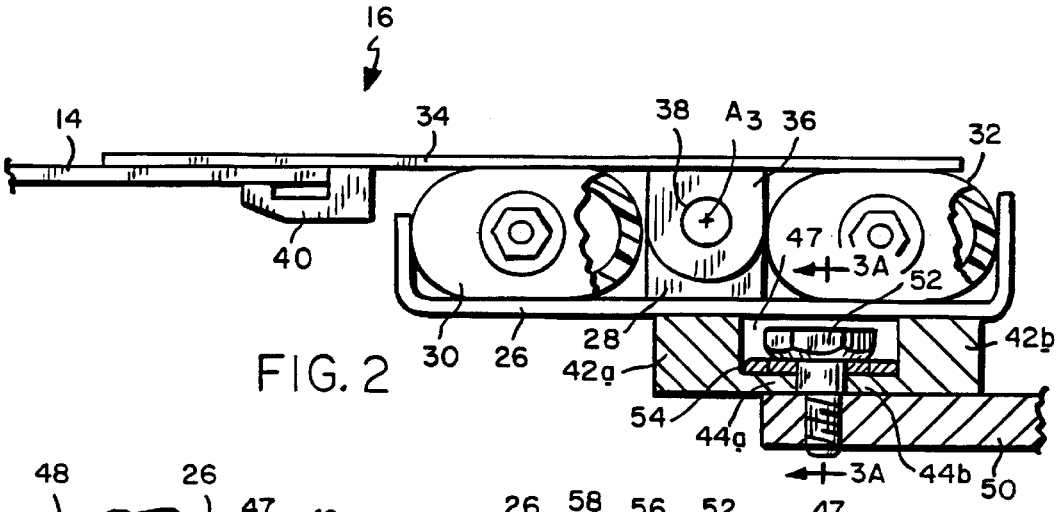
FIG. 2 is an enlarged view of the doctor blade holder shown in FIG. 1.

With reference initially to FIG. 1, a doctor assembly in accordance with the present invention is generally depicted at 10 adjacent to a papermachine roll 12. Roll 12 is driven by conventional means (not shown) for rotation about an axis A, extending in the cross-machine direction. The doctor assembly includes a doctor blade 14, a blade holder 16, a doctor back 18, and a loading mechanism 20. The doctor back is mounted on the papermachine frame for pivotal movement about an axis $A_2$ extending in the cross-machine direction parallel to the rotational axis $A_1$, of roll 12. The loading mechanism 20 includes a piston-cylinder unit 22 acting through lever arm 24 to pivot the doctor back 18 about its axis $A_2$ in order to load the doctor blade 14 against the surface of the roll 12.

With reference additionally to FIGS. 2 and 3A–3C, it will be seen that the blade holder 16 includes a tray 26 with upstanding brackets 28 located between an unloading tube 30 and a loading tube 32. A top pressure plate 34 overlies the tubes 30, 32 and has depending brackets 36 which are connected to the brackets 28 by a rod 38 for pivotal movement about a third axis $A_3$ parallel to axes $A_1$, and $A_2$.

Fingers 40 cooperate with the underside of the top pressure plate 34 to retain the doctor blade 14 in its forwardly extending position. The tubes 30, 32 are fluid actuated, with tube 32 serving to coact with the force being applied by the loading mechanism 20 to apply the blade 14 to the surface of the roll 12. Tube 30 serves to unload the blade from the roll surface, in addition to acting as a front seal.

A pair of L-shaped confronting mounting strips 42*a*, 42*b* are secured to the underside of the tray 26. The mounting strips have horizontal ledges 44*a*, 44*b* spaced one from the other to define a continuous slot 46 communicating with an interior recess 47.

A shelf 50 extends forwardly from and forms an integral part of the doctor back 18. Shoulder screws 52 are threaded into the shelf 50 at spaced locations along the length of the slot 46. A locking strip 54 in interposed between the ledges 44*a*, 44*b* and the heads of the shoulder screws 52. The locking strip is slotted as at 56 to accommodate the shoulder screws, and the slots 56 are partially bordered by resilient tabs 58 which are bent upwardly out of the lane of the locking strip.

Figure 3A:
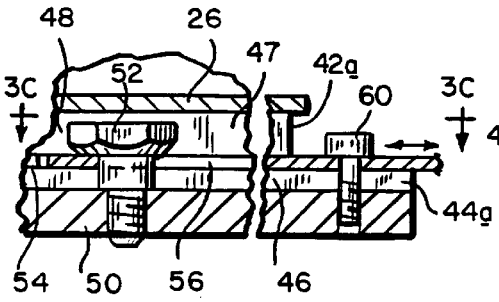
FIG. 3A is a sectional view taken along line 3A—3A of FIG. 2 showing the blade holder in its operative position clamped to the doctor back.

The locking strip 54 is slidable longitudinally with respect to the shelf 50 of the doctor back and the mounting strips 42*a*, 42*b* on the underside of the tray 26. When in the locked position as shown in FIGS. 3A and 3C, the tabs 58 are deflected downwardly by the heads of the shoulder screws 52 into the plane of the strip 54, thereby exerting a downward force which clamps the ledges 44*a*, 44*b* against the shelf 50, thus fixing the doctor holder 16 in its operative position on the doctor back 18. As can be best seen in FIG. 3A, a pin 60 or the like at one side of the papermachine is employed to releasably fix the locking strip 54 in its locked position.

Figure 3B:
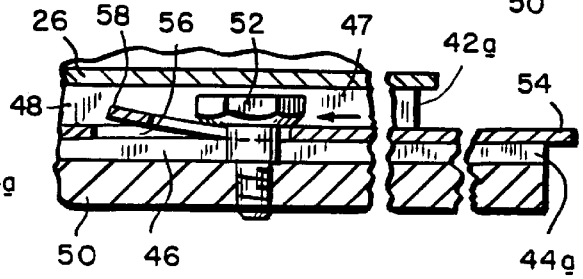
FIG. 3B is a view similar to FIG. 3A showing the blade holder unclamped from the doctor back.
Figure 3C:
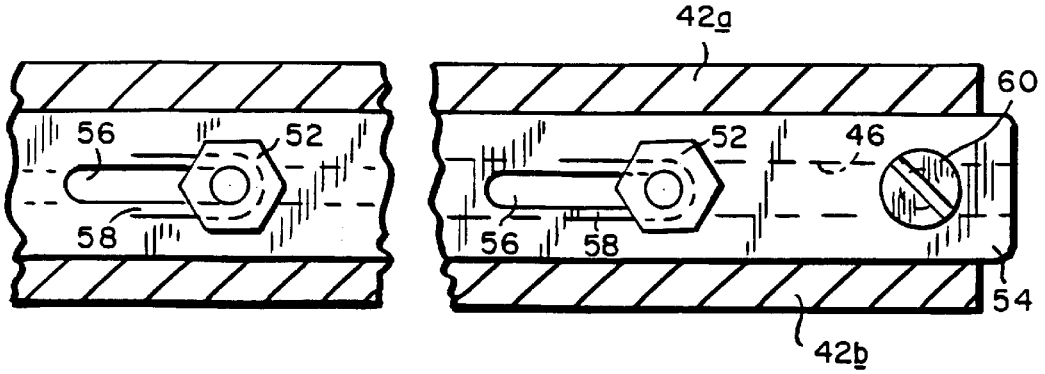
FIG. 3C is a horizontal sectional view taken along line 3C—3C of FIG. 3A.

When it becomes necessary to clean or maintain the blade holder, the pin 60 is removed and the locking strip 54 is shifted to its unlocked position as shown in FIG. 3B. This relieves the clamping force exerted by the resilient tabs 58, thus allowing the blade holder and doctor blade to be extracted longitudinally as a unit out of the papermachine. After cleaning and maintenance, the blade holder is longitudinally reinserted into the papermachine, and the clamping strip returned to its locked position.

An alternative embodiment of the invention is depicted in FIGS. 4 and 5, where a mounting strip 62*a* is secured to the underside of the tray 26. A second mounting strip 62*b* is connected to strip 62*a* by means of shoulder screws 64 extending through angled slots 66. The strips 62*a*, 62*b* coact to define a dovetailed slot 68 for receiving a dovetail strip 70 secured to the doctor back shelf 50 by screws 72. Longitudinal movement of the strip 62*b* in direction A will urge it laterally against the dovetail strip 70, thus clamping the blade holder in place.

Longitudinal movement of the strip 62*b* in the opposite direction B will shift the strip 62*b* laterally away from strip 70, thus freeing the doctor holder for removal from the doctor back. If the strip 62*b* is only shifted slightly laterally, the blade holder can be slid longitudinally into and out of its operative position, whereas a more pronounced lateral shifting of the strip will permit the blade holder to be lifted from and lowered onto the doctor back.

In the embodiment shown in FIGS. 6 and 7, a male dovetail strip 74 is secured to the underside of the tray 26 and a female dovetail strip 76 is secured to the doctor back shelf 50. A set screw 78 at one side of the papermaking machine serves to fix male dovetail the strip 74 against sliding movement relative to the female dovetail strip 76. When the screw 78 is backed off as shown in FIG. 7, the blade holder is free to slide longitudinally into and out of its operative position on the doctor back.

Figure 8:
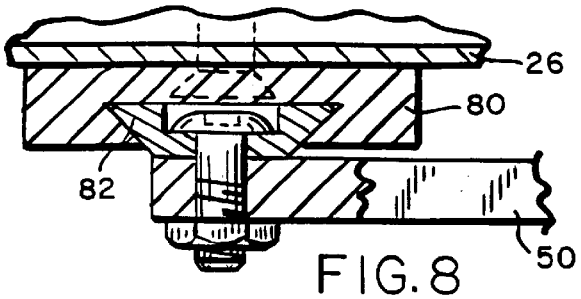
FIG. 8 illustrates another embodiment of a blade holder in accordance with the present invention.
Figure 9:
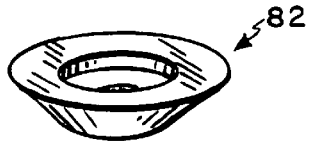
FIG. 9 is a perspective view of one of the dovetail washers employed in the arrangement shown in FIG. 8.

In the embodiment shown in FIGS. 8 and 9, a female dovetail strip 80 is secured to the underside of the tray 26, and frustoconical dovetail washers 82 are secured to and spaced along the length of the doctor back shelf 50.

Figure 10:
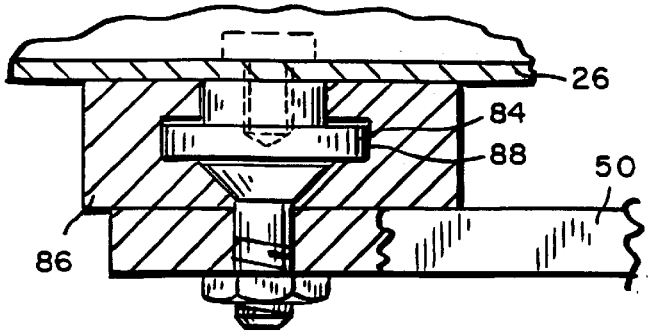
FIG. 10 illustrates still another embodiment of a blade holder in accordance with the present invention.
Figure 11:
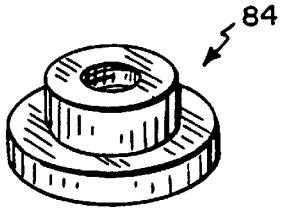
FIG. 11 is a perspective view of one of the stepped washers used in the arrangement shown in FIG. 10.

In FIGS. 10 and 11, stepped washers 84 are secured at spaced locations along the underside of the tray 26, and a mounting strip 86 is secured to the doctor back shelf 50. The mounting strip 86 has an undercut channel 88 along which the stepped washers slide during longitudinal extraction and insertion of the blade holder.

Figure 12:
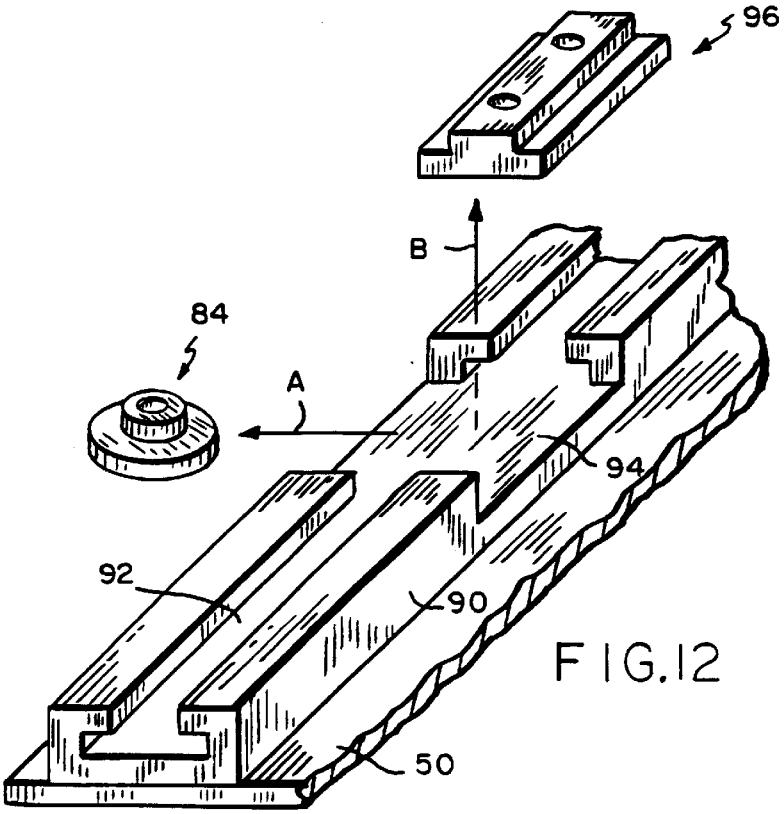
FIG. 12 is a perspective view showing a further modification to blade holders embodying the concepts of the present invention.

FIG. 12 illustrates another embodiment where a mounting strip 90 with an undercut channel 92 is secured to the doctor back shelf 50. The channel 92 is interrupted as at 94 at spaced locations along its length. This allows either the stepped washers 84 of FIGS. 11 or 12 stepped strip segments 96 which are secured to the underside of the blade holder tray 26 to slide along the channel 92 to positions at which they may exit via the interrupted sections 94 either laterally in direction A or vertically in direction B.

Figure 13:
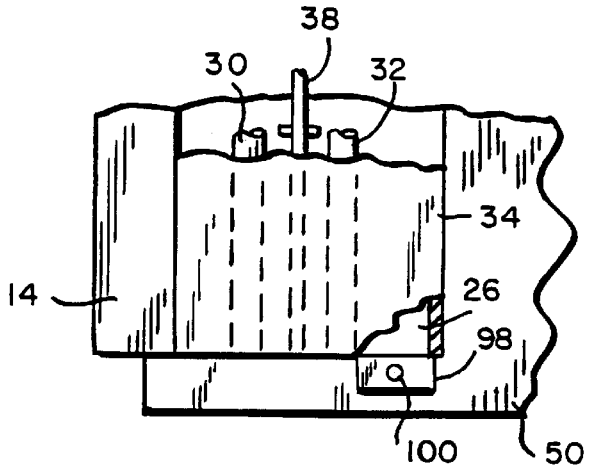
FIG. 13 is a partial plan view of the blade holder and doctor back at one side of the papermachine.

In the embodiments shown in FIGS. 8 to 12, a locking means of some type is provided at one side of the machine to prevent removal of the blade holder from the doctor back during operation of the papermachine. As shown in FIG. 13, locking can be achieved by providing a bracket 98 on the tray 26 at one side of the papermachine which is detachably connected to the doctor back shelf 50 by a pin 100 or the like.

In light of the foregoing, it will now be appreciated by those skilled in the art that the present invention provides for ready separation of the doctor blade holder from the doctor back for removal from the papermachine. The embodiments illustrated in FIGS. 1–5 provide means for securely clamping the blade holder to the doctor back during operation of the papermachine. Other embodiments as illustrated in FIGS. 6–13 lock the blade holder in its operative position, but do not exert additional clamping forces. All arrangements are advantageous in that removability of the blade holder provides maintenance personnel with the opportunity to clean and perform maintenance outside of the papermachine, without disturbing the doctor back.

We claim:

1. In a papermachine having a roll rotating about an axis extending in a cross-machine direction, an apparatus for doctoring said roll, said apparatus comprising:

a doctor blade;

a blade holder comprising an integral unit including means for applying said doctor blade to the surface of said roll;

a doctor back;

mounting means for removably mounting said blade holder on said doctor back in an operative position adjacent said roll and extending in said cross-machine direction; and locking means coacting with said mounting means for securing said blade holder to said doctor back in said operative position, said locking means being accessible and operable from a side of said papermachine and being releasable to accommodate removal of said blade holder as an integral unit from said doctor back.

2. The apparatus of claim 1 wherein said mounting means is configured to accommodate movement of said blade holder into and out of said operative position in said cross-machine direction.

3. The apparatus as claimed in claim 1 wherein said mounting means is configured to accommodate movement of said blade holder into and out of said operative position in a direction transverse to said cross-machine direction.

4. The apparatus as claimed in claim 1 wherein a component on said blade holder coacts in mechanical interengagement with a mating component on said doctor back, at least one of said components extending longitudinally in said cross-machine direction.

5. The apparatus as claimed in claim 4 wherein said mechanically interengaged components each extend coextensively in said cross-machine direction.

6. The apparatus as claimed in claim 5 wherein said locking means comprises a slidable element interposed between said mechanically interengaged components.

7. The apparatus as claimed in claim 6 wherein said slidable element includes resilient means for urging said mechanically interengaged components apart when said blade holder is releasably secured to said doctor back.

* * * * *